US011278069B2

(12) United States Patent
Bedrosian

(10) Patent No.: US 11,278,069 B2
(45) Date of Patent: Mar. 22, 2022

(54) GLOVE ASSEMBLY AND METHOD OF USING SAME

(71) Applicant: Bedrosian Global, LLC, Malibu, CA (US)

(72) Inventor: Bert Bedrosian, Malibu, CA (US)

(73) Assignee: BEDROSIAN GLOBAL, LLC, Beverly Hills, CA (US)

( * ) Notice: Subject to any disclaimer, the term of this patent is extended or adjusted under 35 U.S.C. 154(b) by 0 days.

(21) Appl. No.: 17/308,485

(22) Filed: May 5, 2021

(65) Prior Publication Data

US 2021/0345716 A1 Nov. 11, 2021

Related U.S. Application Data

(60) Provisional application No. 63/020,429, filed on May 5, 2020.

(51) Int. Cl.
*A41D 19/00* (2006.01)
*A41F 1/06* (2006.01)

(52) U.S. Cl.
CPC ..... *A41D 19/0082* (2013.01); *A41D 19/0006* (2013.01); *A41D 19/0044* (2013.01); *A41D 19/0058* (2013.01); *A41F 1/06* (2013.01)

(58) Field of Classification Search
CPC ..... A41D 19/0006; A41D 2500/50; A41D 19/0044; A47L 13/18
See application file for complete search history.

(56) References Cited

U.S. PATENT DOCUMENTS

| | | | | |
|---|---|---|---|---|
| 4,696,065 | A * | 9/1987 | Elenteny | A41D 19/0058 2/164 |
| 6,032,294 | A * | 3/2000 | Dean | A41B 11/002 2/239 |
| 6,360,373 | B1 * | 3/2002 | Rehn | A41D 19/0068 15/227 |
| 6,973,675 | B2 * | 12/2005 | Cheng | A41D 19/0058 2/161.7 |
| 9,241,518 | B2 * | 1/2016 | Patkov | A41D 19/01505 |
| 2008/0016601 | A1 * | 1/2008 | McCrorey | A41D 19/0006 2/159 |
| 2016/0316986 | A1 * | 11/2016 | Oster | A47L 13/18 |

* cited by examiner

*Primary Examiner* — Tajash D Patel
(74) *Attorney, Agent, or Firm* — Jeffer Mangels Butler & Mitchell LLP; Brennan C. Swain, Esq.

(57) ABSTRACT

A nested glove assembly that includes a first glove that includes a front, a back, a thumb side, a pinky side, a first cuff and a plurality of finger portions that cooperate to define a first glove interior, and a second glove that includes a front, a back, a thumb side, a pinky side, and a second cuff and a plurality of finger portions that cooperate to define a second glove interior. A first tab extends from the first cuff and the second glove is positioned in the first glove interior.

15 Claims, 3 Drawing Sheets

GLOVE ASSEMBLY AND METHOD OF USING SAME

CROSS REFERENCE TO RELATED APPLICATIONS

This application claims the benefit of U.S. Provisional Application No. 63/020,429, filed May 5, 2020, the entirety of which is incorporated herein by reference.

FIELD OF THE INVENTION

The present invention relates generally to disposable gloves, and more particularly to a set of nested gloves and a kit therefor.

BACKGROUND OF THE INVENTION

During the current world pandemic and for other health reasons, people often where rubber disposable gloves. However, once a glove has been contaminated and is removed, the person may then have their bare hand exposed to unwanted contamination. For example, after shopping with a pair of gloves, the person may remove their glove to touch their wallet and remove their credit card. However, after paying they may have to touch the shopping cart once again. It would be advantageous if the person had a second clean glove under the first contaminated glove. Therefore, a need exists for nested gloves.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided a glove assembly or nested glove assembly that includes a first glove that includes a front, a back, a thumb side, a pinky side, a first cuff and a plurality of finger portions that cooperate to define a first glove interior, and a second glove that includes a front, a back, a thumb side, a pinky side, and a second cuff and a plurality of finger portions that cooperate to define a second glove interior. A first tab extends from the first cuff and the second glove is positioned in the first glove interior. In a preferred embodiment, a second tab extends from the second cuff.

In a preferred embodiment, the first tab includes a first indicator thereon, and the second tab includes a second indicator thereon. Preferably, the first indicator is a letter or a number, and the second indicator is a letter or a number. The letters and numbers are preferentially sequential.

In a preferred embodiment, the first cuff is longer than the second cuff. In a preferred embodiment, the first glove is larger than the second glove. In a preferred embodiment, the first tab is attached to the first cuff and the second tab is attached to the second cuff (e.g., via stitching, glue, welding or the like). Preferably, the first tab is a different material than the first glove and the second tab is a different material than the second glove. Preferably, the tabs are made of a sturdier or stronger material than the glove material (e.g., plastic, cardboard, paper, metal, cloth, fabric, etc.). In a preferred embodiment, the first cuff defines a first circumference, the second cuff defines a second circumference, and the second tab is circumferentially offset (on the second circumference) from the first tab (on the first circumference). In another embodiment, the second tab is circumferentially aligned with the first tab.

In a preferred embodiment, at least one of finger portions on the first glove includes a first securing member on an inside surface of the finger portion, at least one of finger portions on the second glove includes a second securing member on an outside surface of the finger portion, and the first finger portion is secured to the second finger portion.

In accordance with another aspect of the present invention there is provided a method performed by a user with a first hand that includes obtaining a glove assembly that includes a first glove that includes a front, a back, a thumb side, a pinky side, a first cuff and a plurality of finger portions that cooperate to define a first glove interior, and a second glove that includes a front, a back, a thumb side, a pinky side, a second cuff and a plurality of finger portions that cooperate to define a second glove interior. A first tab extends from the first cuff, and the second glove is positioned in the first glove interior. The method includes placing the glove assembly on the first hand, using the first glove to perform a first task, grasping the first tab and removing the first glove, and using the second glove to perform a second task.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
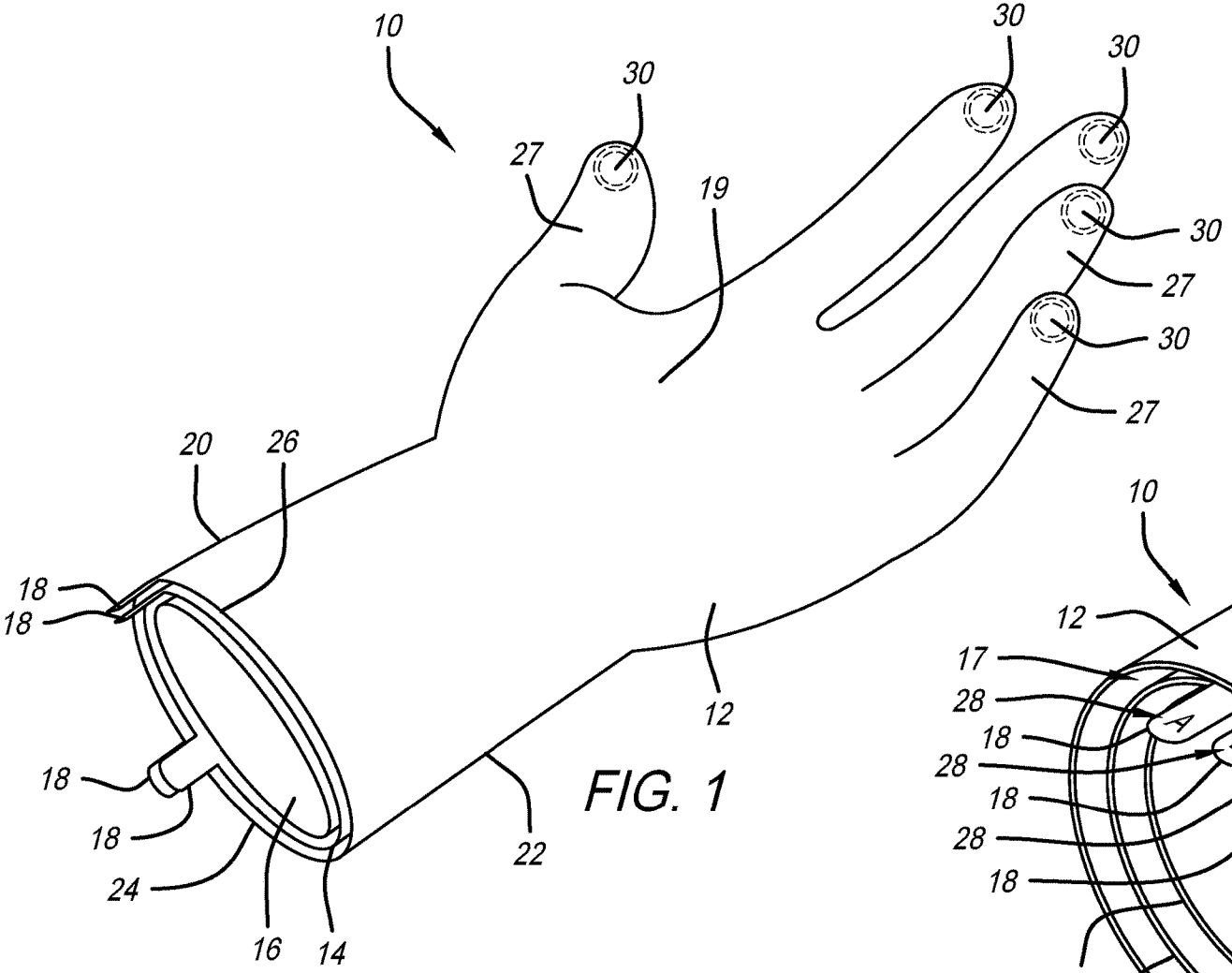
FIG. 1 is a perspective view of a nested gloves assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
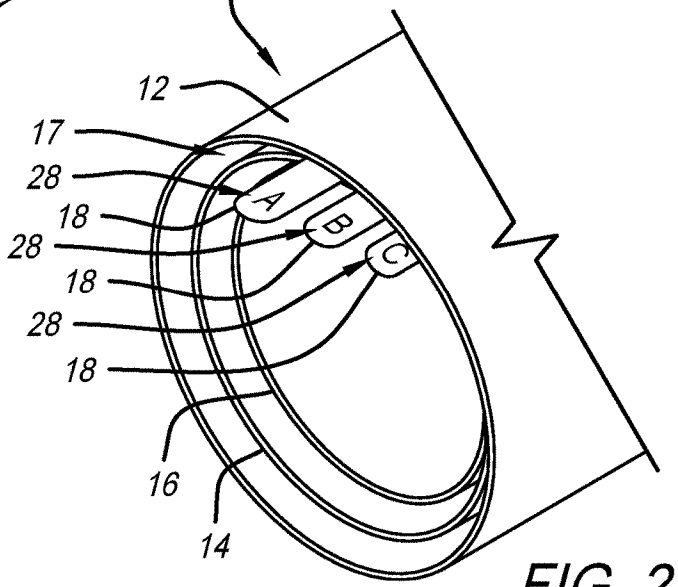
FIG. 2 is a perspective view a portion of the glove assembly of FIG. 1 showing indicators on the tabs.

Referring now to the drawings, wherein the showings are for purposes of illustrating the present invention and not for purposes of limiting the same, FIGS. 1-4 show embodiments of a glove assembly 10 that includes at least first and second gloves 12 and 14 therein. As shown in FIG. 1, which includes three gloves (see third glove 16), more than two gloves can be included in the nested glove assembly 10. More than three gloves is also within the scope of the present invention. The second glove 14 is nested, positioned, disposed or stacked within the first glove 12 and the third glove 16 is disposed within the second glove 14. The interior or inner space defined within the glove is referred to as the glove interior 17, as shown in FIG. 2. In use, a person can place the entire nested glove assembly 10 on their hand and then use and remove each glove independently, as desired.

It will be appreciated that each glove includes a front or palm side 19, a thumb side 20, a pinky side 22, a back 24, a cuff 26 and a plurality of finger portions 27. Preferably, there are five finger portions 27, including the thumb. However, the gloves can be designed as a mitten (e.g., two finger portions, one for the thumb and one for the four fingers) or in another configuration. As shown in FIG. 1, in a preferred embodiment, at least the first or outermost glove 12 includes one or more tabs 18 thereon. The tabs 18 are used to make it easier for a user to remove the outer glove. In use, If the user grasps for the cuff 26 of the first glove 12, they may accidentally grasp the cuff 26 of one of the inner gloves or they may grasp the cuff of more than one glove. In a preferred embodiment, there may be tabs 18 on the outermost glove and any intervening glove (which will be the "outer" or "outermost glove" after the glove on the outside thereof is removed) and not on the innermost glove. For example, as shown in FIG. 1, the first and second gloves 12 and 14 include tabs 18 and the third innermost glove 16, does not. In another embodiment, the innermost glove may also include one or more tabs 18.

Figure 3:
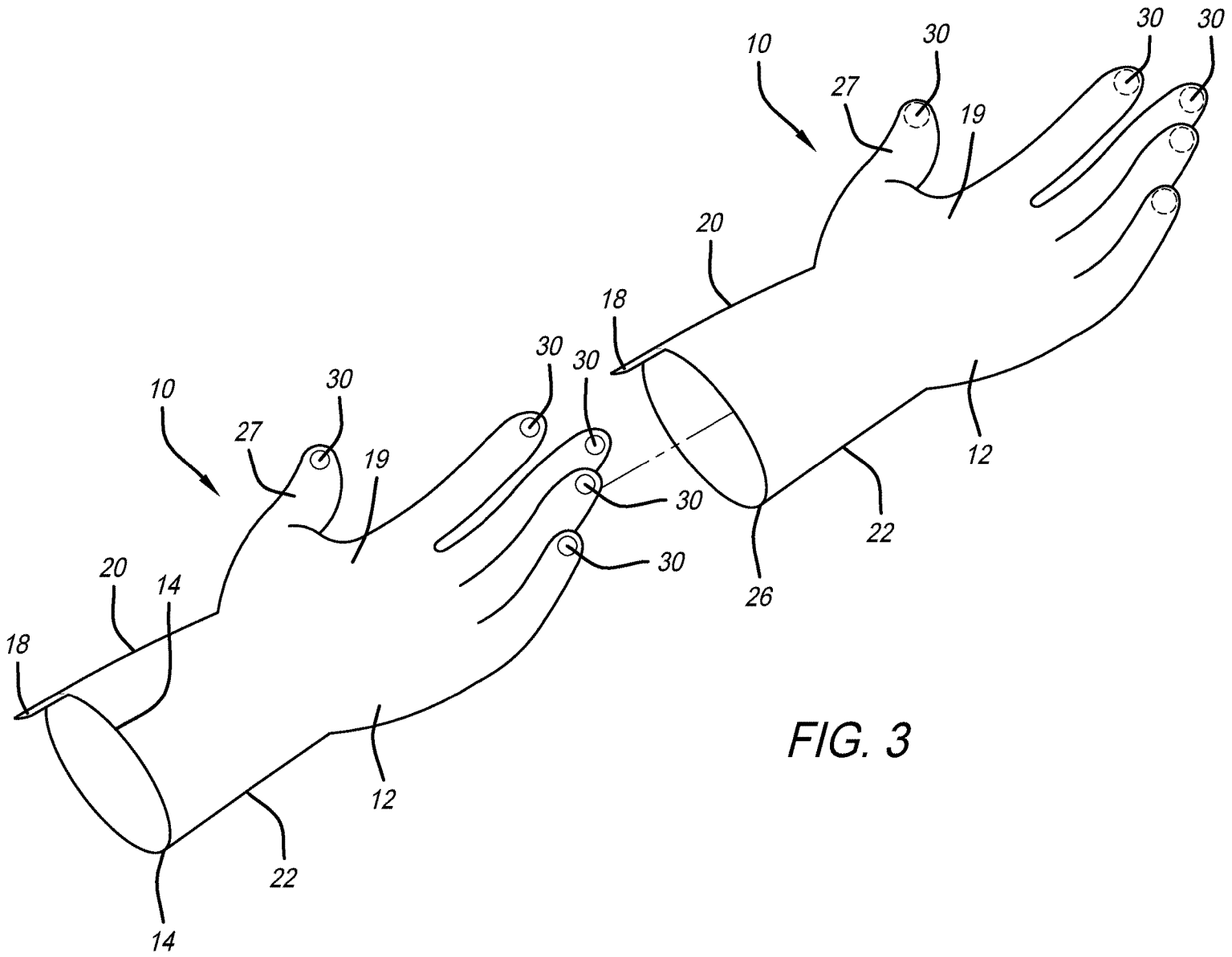
FIG. 3 is an exploded perspective view two gloves that are a part of a glove assembly.

The tabs 18 can be placed at any position on the glove, and/or around the cuff 26 and preferably in a position that makes it easier to remove the glove. For example, as shown in FIG. 1, both the first and second gloves 12 and 14 include tabs 18 extending outwardly from the cuff 26 on the thumb side 20. FIG. 1 also shows tabs 18 on the first and second gloves 12 and 14 extending outwardly from the cuff 26 on the back side 24. It will be appreciated that FIG. 1 shows both locations for the tab, as discussed above. However, in production, each glove within the glove assembly only includes a single tab. In another embodiment, each glove may include multiple tabs. Furthermore, the first and second gloves 12 and 14 may include tabs 18 in different locations from one another, e.g., a tab 18 on the thumb side 20 on the first glove 12 and a tab 18 on the back side 24 on the second glove 14, or tabs near one another (i.e., staggered or offset), but not stacked or overlapping to make it easier to grasp the tabs independently, as shown in FIG. 2. As can be seen in FIG. 2, the cuffs 26 of the first and second gloves are circular or ovular or other rounded or curved geometric figure or shape and therefore include a circumference. As shown, the tab 18 on the second glove 14 is circumferentially offset from the tab 18 on the first glove 12 (and the tab on the third glove), and the tab 18 on the third glove 16 is circumferentially offset from the tabs on the first and second gloves. As shown in FIG. 1, the tabs 18 can also be stacked or aligned with another (i.e., circumferentially aligned). Tabs 18 can be positioned anywhere around the glove, i.e., the pinky side 22 and the palm side 19. The tabs can be any portion that extends from the cuff or near the cuff of the glove and allows a user to grasp the tab and pull the glove off. The tabs 18 may be unitary or formed of the same material as the remainder of the glove, as shown in FIGS. 1 and 3, or the tabs 18 may be adhered, attached or otherwise secured to the glove (e.g., by stitching, glue, stapling, etc.), as shown in FIG. 2. The tab may also be any shape, e.g., square, rectangular, round, curved, a loop, a band with a center opening, an elastic band, etc. Tabs may also be included on the finger tips to make gloves easier to pull off.

In a preferred embodiment, the first and second gloves 12 and 14 can include securing members 30 therebetween that keep the first and second gloves 12 and 14 secured to one another while in the kit described below and during use. The securing members 30 may be adhesive on the inside surface of one or more of the of the tips of the first glove 12 and on the outer surface of the tips of the fingers of the second glove 14 (and any other gloves in the stack). The securing members 30 may also be hook and loop material (i.e., Velcro) or other securing pads. The securing members 30 are detached from one another when the user pulls the first glove 12 off of the second glove 14. The same arrangement is preferably included between the second and third gloves 14 and 16. The securing members 30 can also be omitted. The securing members 30 may be included on all of the fingers (and thumb) or as few as one.

As shown in FIG. 2, in a preferred embodiment, the tabs 18 include numbering or other identifying indicia 28 thereon that indicate to the user the order in which to grasp and use the tabs 18 to remove the gloves. For example, see the letters "A", "B", and "C" on the tabs 18 of the first, second and third gloves 12, 14 and 16 in FIG. 2 indicating to the user to grasp the tab 18 labeled "A" first to remove the outermost first glove 12 and "B" to remove the second glove 14. The indicia 28 may also be referred to herein as indicators 28. In another embodiment, the indicators may be omitted.

In another embodiment the gloves can be different lengths to allow the user to grasp the proper cuff. For example, as shown in FIG. 2, the first glove 12 can be the longest (i.e., when worn it extends the furthest up the wearer's wrist/arm) and the inner gloves can get progressively shorter so that the cuffs are not all aligned. For example, the second glove can be 0.5" shorter than the first glove and the third glove can be 0.5" shorter than the second glove. This may be used in an embodiment either with or without tabs.

In another embodiment, the indicia 28 can be on the cuffs 26 of the gloves so that the user can read the indicia and know which cuff 26 to grasp to remove the glove. This may be used in an embodiment either with or without tabs. In another embodiment, the indicia can be color coding. In other words, the tab or the entire glove can be a first color and the other gloves (or the tabs thereon) can be different (i.e., second and third colors).

Figure 4:
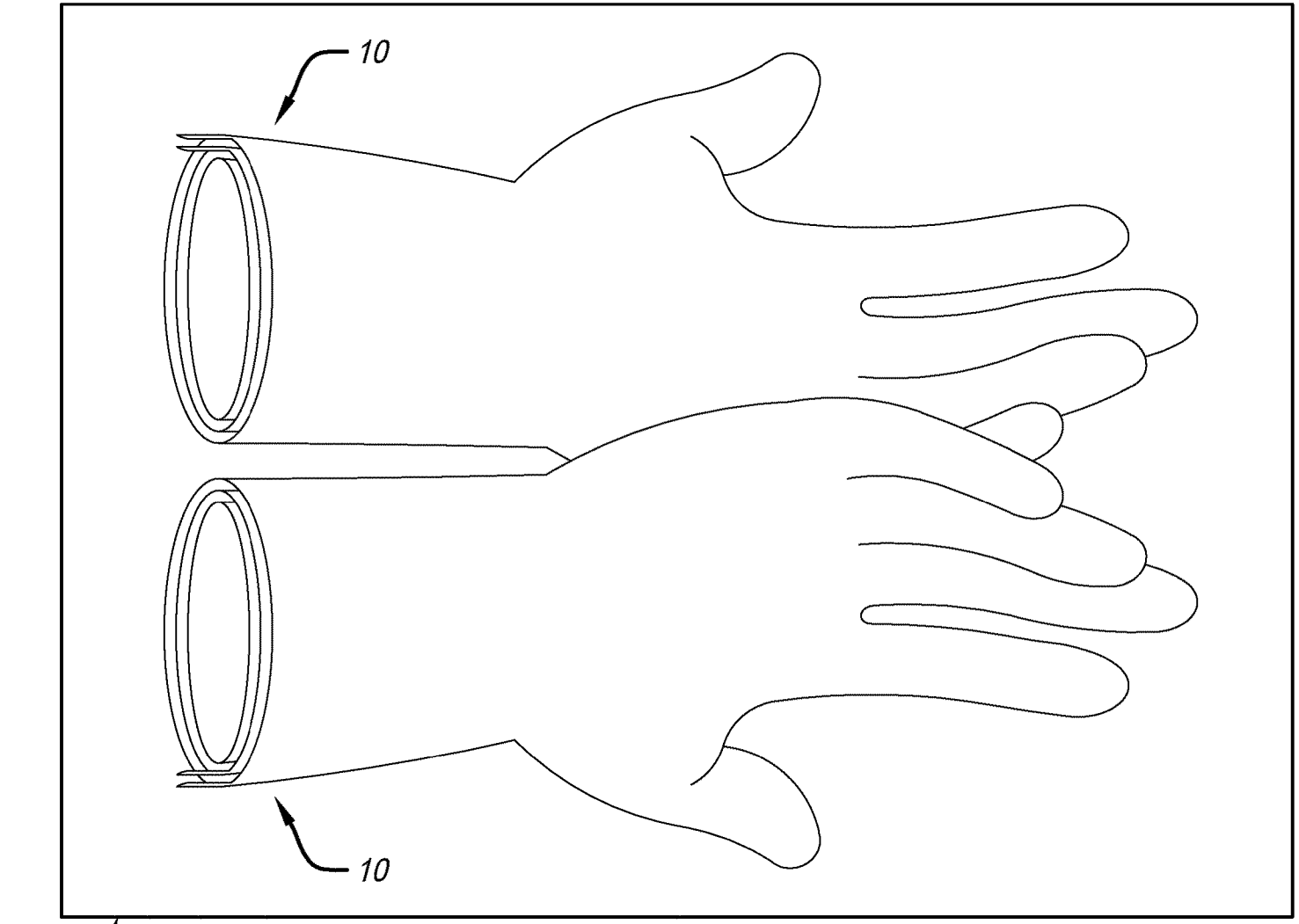
FIG. 4 is a schematic view of a pair of glove assemblies within a kit.

As shown in FIG. 4, in a preferred embodiment, a pair of glove assemblies 10 (for the left and right hands) are delivered or sold together within a kit 40. The gloves come pre-nested within the kit 40. Preferably, the kit 40 includes a plurality of pairs of glove assemblies 10.

Traditionally, gloves come in half sizes. In a preferred embodiment, the outer gloves may be a half size or more larger than one or more of the inner gloves. Certain of the gloves within the assembly could include a wider than usual wrist area or cuff for ease of removal. The present invention can also be applied to mittens. The gloves can be any type of material or any type of glove. In a preferred embodiment, the gloves are disposable gloves that may be used in surgery or other medical procedures and gloves can be made of latex, nitrile, vinyl or a similar material. Preferably, each of the gloves in the gloves assembly are made of the same material and are the same type of glove.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A glove assembly comprising:

a first glove that includes a front, a back, a thumb side, a pinky side, a first cuff and a plurality of finger portions that cooperate to define a first glove interior, wherein a first tab extends from the first cuff, and a second glove that includes a front, a back, a thumb side, a pinky side, a second cuff and a plurality of finger portions that cooperate to define a second glove interior, wherein the second glove is positioned in the first glove interior, wherein at least one of the finger portions on the first glove includes a first securing member on an inside surface of the finger portion, wherein at least one of the finger portions on the second glove includes a second securing member on an outside surface of the finger portion, wherein the first finger portion is secured to the second finger portion, and wherein the first and second securing members comprise a hook and loop material.

2. The glove assembly of claim 1 wherein a second tab extends from the second cuff.

3. The glove assembly of claim 2 wherein the first tab includes a first indicator thereon, and wherein the second tab includes a second indicator thereon.

4. The glove assembly of claim 3 wherein the first indicator is a letter or a number, and wherein the second indicator is a letter or a number.

5. The glove assembly of claim 1 wherein the first cuff is longer than the second cuff.

6. The glove assembly of claim 1 wherein the first glove is larger than the second glove.

7. The glove assembly of claim 1 wherein the first tab is attached to the first cuff, and wherein the second tab is attached to the second cuff.

8. The glove assembly of claim 7 wherein the first tab is a different material than the first glove, and wherein the second tab is a different material than the second glove.

9. The glove assembly of claim 2 wherein the second tab is circumferentially offset from the first tab.

10. The glove assembly of claim 2 wherein the second tab is circumferentially aligned with the first tab.

11. A glove assembly comprising:

a first glove that includes a front, a back, a thumb side, a pinky side, a first cuff and a plurality of finger portions that cooperate to define a first glove interior, wherein a first tab is attached to the first cuff, wherein the first tab includes a first indicator thereon, wherein the first indicator is a letter or a number, and wherein the first tab is a different material than the first glove, and a second glove that includes a front, a back, a thumb side, a pinky side, a second cuff and a plurality of finger portions that cooperate to define a second glove interior, wherein a second tab is attached to the second cuff, wherein the second tab includes a second indicator thereon, wherein the second indicator is a letter or a number, wherein the second tab is a different material than the second glove, wherein the second glove is positioned in the first glove interior, and wherein the second tab is circumferentially offset from the first tab, wherein at least one of the finger portions on the first glove includes a first securing member on an inside surface of the finger portion, wherein at least one of the finger portions on the second glove includes a second securing member on an outside surface of the finger portion, wherein the first finger portion is secured to the second finger portion, and wherein the first and second securing members comprise a hook and loop material.

12. The glove assembly of claim 11 wherein the first cuff is longer than the second cuff.

13. The glove assembly of claim 11 wherein the first glove is larger than the second glove.

14. A method performed by a user with a first hand, the method comprising the steps of:

obtaining a glove assembly that includes a first glove that includes a front, a back, a thumb side, a pinky side, a first cuff and a plurality of finger portions that cooperate to define a first glove interior, and a second glove that includes a front, a back, a thumb side, a pinky side, a second cuff and a plurality of finger portions that cooperate to define a second glove interior, wherein a first tab extends from the first cuff, and wherein the second glove is positioned in the first glove interior, wherein at least one of the finger portions on the first glove includes a first securing member on an inside surface of the finger portion, wherein at least one of the finger portions on the second glove includes a second securing member on an outside surface of the finger portion, wherein the first finger portion is secured to the second finger portion, and wherein the first and second securing members comprise a hook and loop material, placing the glove assembly on the first hand, using the first glove to perform a first task, grasping the first tab and removing the first glove, whereby the first and second securing members are disengaged from one another, and using the second glove to perform a second task.

15. The method of claim 14 wherein a second tab extends from the second cuff, and wherein the method includes the step of grasping the second tab and removing the second glove.

* * * * *